US006151808A

United States Patent [19]

Curtis

[11] Patent Number: 6,151,808

[45] Date of Patent: Nov. 28, 2000

[54] JACK FOR A SNOW PLOW

[75] Inventor: Marc D. Curtis, Spencer, Mass.

[73] Assignee: Curtis International, Inc., Worcester, Mass.

[21] Appl. No.: 09/300,649

[22] Filed: Apr. 27, 1999

Related U.S. Application Data

[63] Continuation-in-part of application No. 09/222,448, Dec. 29, 1998, which is a continuation-in-part of application No. 09/134,555, Aug. 14, 1998.

[51] Int. Cl.[7] ..... E01H 5/04; B60S 9/02

[52] U.S. Cl. ..... 37/234; 37/235; 254/423

[58] Field of Search ..... 37/231, 232, 234, 37/235, 236; 254/418, 419, 420, 423

[56] References Cited

U.S. PATENT DOCUMENTS

| | | | |
|---|---|---|---|
| 2,046,918 | 7/1936 | Kruse | 254/418 |
| 2,322,358 | 6/1943 | Hansen | 254/418 |
| 2,383,666 | 8/1945 | Martin | 254/418 |
| 2,555,925 | 6/1951 | Genthe | 254/418 |
| 2,840,391 | 6/1958 | Stiel | 254/418 |
| 3,150,884 | 9/1964 | Drott | 254/418 |
| 3,793,752 | 2/1974 | Snyder | 37/42 R |
| 3,801,068 | 4/1974 | Kopas | 254/86 R |
| 3,860,216 | 1/1975 | Brown | 254/418 |
| 4,187,624 | 2/1980 | Blau | 37/42 R |
| 4,205,825 | 6/1980 | Stanford | 254/86 R |
| 4,439,939 | 4/1984 | Blau | 37/231 |
| 4,574,502 | 3/1986 | Blau | 37/266 |
| 4,662,610 | 5/1987 | Cofer | 254/420 |
| 4,711,428 | 12/1987 | Carpenter | 254/423 |
| 4,821,435 | 4/1989 | Pester | 37/231 |
| 5,014,452 | 5/1991 | Berghefer | 37/235 |
| 5,087,063 | 2/1992 | Merrill, Jr. | 280/475 |
| 5,125,174 | 6/1992 | Watson et al. | 37/231 |
| 5,195,261 | 3/1993 | Vachon | 37/231 |
| 5,353,530 | 10/1994 | Pieper | 37/231 |
| 5,397,187 | 3/1995 | Cachinero et al. | 384/460 |
| 5,485,690 | 1/1996 | MacQueen | 37/271 |
| 5,524,368 | 6/1996 | Struck et al. | 37/235 |
| 5,568,694 | 10/1996 | Capra et al. | 37/231 |
| 5,743,339 | 4/1998 | Alexander, III | 172/272 |
| 5,806,214 | 9/1998 | Behrens et al. | 37/231 |
| 5,894,688 | 4/1999 | Struck et al. | 37/271 |
| 5,924,223 | 7/1999 | Hone, Jr. | 37/231 |

*Primary Examiner*—Eileen D. Lillis
*Assistant Examiner*—Gary S. Hartmann
*Attorney, Agent, or Firm*—Needle & Lemack

[57] ABSTRACT

Jack for raising and lowering a lift assembly for hydraulically driven snow blades or other utilitarian accessories. Actuation of the jack allows for proper vertical alignment of the lift assembly for engagement to a vehicle chassis. Once engaged, the jack can be actuated into an inoperative position until the lift assembly is to be removed from the chassis.

7 Claims, 7 Drawing Sheets

JACK FOR A SNOW PLOW

This application is a continuation-in-part of Ser. No. 09/222,448 filed Dec. 29, 1998, which is a continuation-in-part of Ser. No. 09/134,555 filed Aug. 14, 1998, each of which is hereby incorporated herein by reference.

BACKGROUND OF THE INVENTION

Conventional snow blade mounts for four wheel drive vehicles such as pick-up trucks can weigh several hundred pounds, and generally include a chassis frame that can be permanently fixed to the vehicle chassis, usually behind the vehicle front bumper. A lift frame is then removably coupled to the chassis frame, and the snow blade is then coupled to the front end of the assembly via an A-frame and trip frame assembly. The A-frame with the snow blade attached is typically removable from the vehicle. Conventionally, the lift frame has been permanently mounted to the chassis frame (and therefore not readily removable from the vehicle), and the hydraulic pump used to operate the snow blade was located under the vehicle hood, and were driven using a belt drive driven by the vehicle engine. However, safety considerations now often dictate that the lift frame be removed when the plow is not in use.

One drawback of conventional snow blade mounts is the difficulty in readily attaching and removing the lift frame assemblies from the vehicle chassis, especially in view of their weight. To that end, U.S. Pat. No. 5,125,174 discloses a removable snowplow including a removable lift frame and A-frame combination. However, the lift frame assembly is permanently mounted to the A-frame, thus requiring removal of both simultaneously, as a unit. U.S. Pat. No. 5,353,530 is of a similar vein.

Conventional mounting systems utilize a pin arrangement, whereby the vehicle and mount assembly must be properly aligned prior to coupling the mount to the chassis with a pair of pins. This mounting and dismounting is difficult and tedious.

It is therefore an object of the present invention to provide a snow blade mount and lift assembly for a vehicle that is easily attachable and removable from the vehicle.

It is a further object of the present invention to provide a snow blade hitch mount that includes a jack for lifting the assembly for proper vertical alignment with the vehicle chassis mount receiving unit.

SUMMARY OF THE INVENTION

The problems of the prior art have been overcome by the present invention, which provides a jack for a mount and lift assembly for snow blades or other accessories. A plow assembly and lift frame are removably coupled to a mounting frame attached to the bottom of the vehicle chassis. The jack enables proper positioning of the lift frame relative to the vehicle chassis for easy mounting and dismounting thereto.

DETAILED DESCRIPTION OF THE INVENTION

Figure 1:
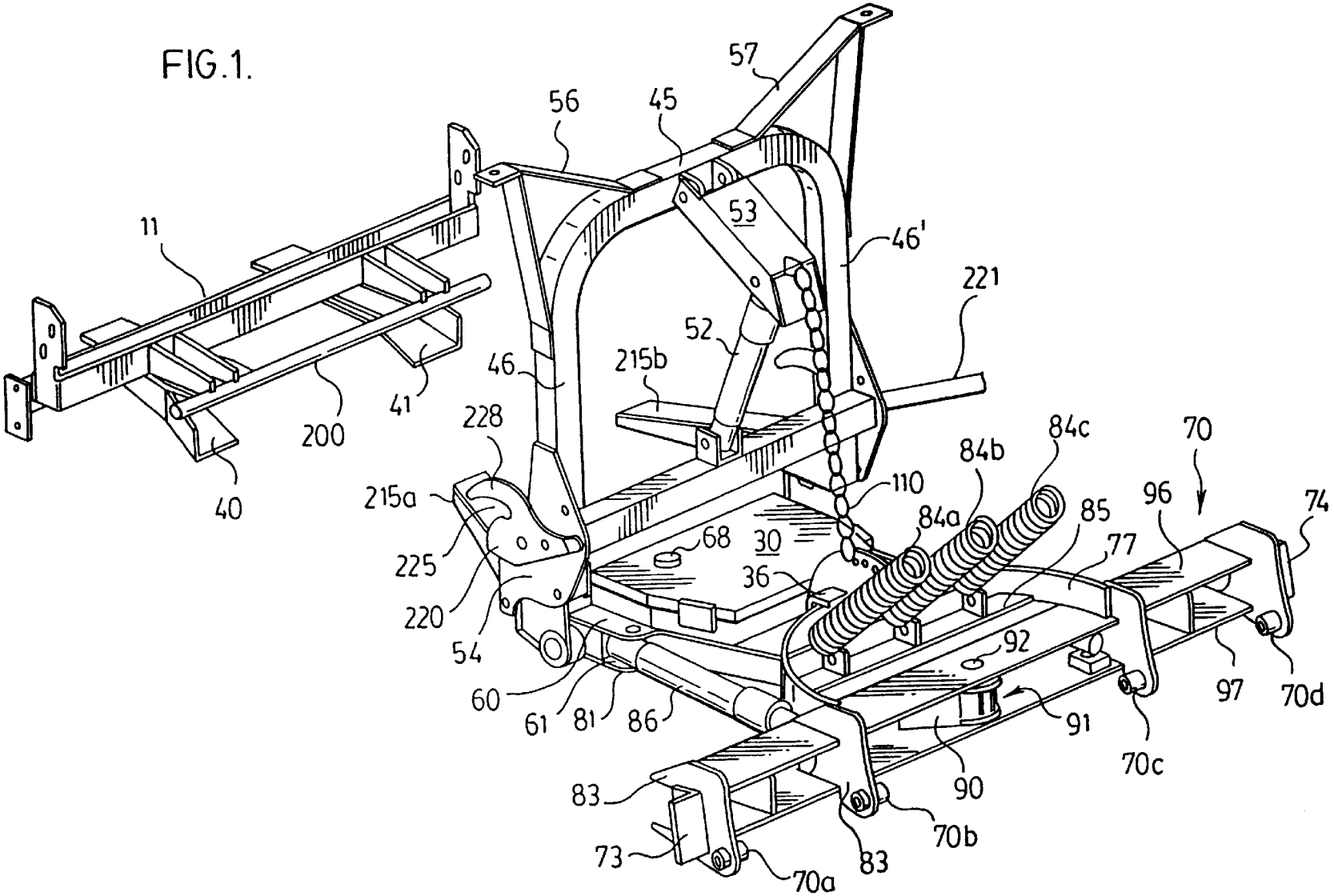
FIG. 1 is a perspective exploded view of an exemplary snow blade mounting system that can be used in accordance with the present invention.

Turning first to FIG. 1, there is shown generally at 10 a snow blade lift and hitch assembly that is suitable for use in the present invention. Those skilled in the art will appreciate that the assembly shown is for purposes of illustration, and that the invention is not limited to any particular lift and hitch assembly design. For example, although the illustrative embodiment includes the use of an A-frame, T-frames or other designs could be used.

Vehicle mounted receiver frame 11 attaches to the vehicle the chassis frame (not shown) behind the front bumper by means of pins or bolts (not shown). Any suitable means can be used to secure the receiver plate 11 to the chassis, such as bolting. The actual design of the receiver plate 11 interface for attachment to the chassis will depend upon the identity (and thus design) of the particular chassis, and is well within the skill in the art.

The receiver plate 11 preferably remains permanently mounted to the vehicle chassis, regardless of whether the snow blade or other accessories are in use. Its main purpose is to provide a means of attachment of the follow-on components, such as those that provide the lift and angle of the snow blade where the follow-on component is a snow blade, and to absorb and transfer any shock loads imposed on the snow blade (or other accessory) into the vehicle chassis.

A receiver arrangement is created for the removable lift frame 10 and A-frame 30 integral therewith, or for any other accessory to be attached to the vehicle via the receiver plate 11. A pair of spaced side guides 40, 41 extend vertically downward from the frame 11, and then inward toward each other as shown. Two spaced discontinuous male portions 215*a* and 215*b* tapering towards each other extend from the lift assembly 10 as shown. Each male portion 215*a'* and 215*b'* is configured to be received by the corresponding spaced female guide members 40, 41 of the receiver 11. Alternatively, the male portions could be located on the receiver 11, and the female portions on the lift assembly 10.

Tubular lift frame 10 and A-frame 30 assembly is adapted to be releasably coupled to the receiver frame 11. The following description of the lift frame 10 and A-frame 30 is similar to that disclosed in co-pending U.S. Ser. No. 08/640,145, the disclosure of which is incorporated herein by reference, although those skilled in the art will appreciate that the present invention is not limited to that particular lift frame and A-frame design. The lift frame 10 as shown has a generally rectangular shape, although the present invention is not to be so limited. A transverse vertical actuator support tube 50 is coupled to the frame 10 between side gusset plates 54, 55, and includes a central bracket 51 for attachment of one end of a vertical lifting means 52 such as hydraulically driven actuator or cylinder. The opposite end of the vertical lifting means 52 is coupled to pivot hood 53, which in turn is pivotally mounted to the underside of top cross bar 45 of the frame 10 as shown. The pivot hood 53 has means to which one operative end of a linking means such as a chain 110 or the like can be mounted. The other operative end of the linking means is mounted by any suitable means to an angle iron coupled to the snow plow blade, so that actuation of the vertical lifting means 52 causes a corresponding vertical lift of the hood 53, which thereby lifts the snow plow blade.

Side gussets 54, 55 are shown coupled to vertical legs 46, 46' of the lift frame 10, such as by welding, and will be discussed in greater detail below. Triangular light mounts 56, 57 are provided on the frame 10 to support additional lighting or the like. Fixed to inside edges of the legs 46, 46' of the lift frame 10 are opposite right angle A-frame limit stops 98, 99 (only 99 shown) positioned to prevent the A-frame 30 from lifting too high.

A compartment in the A-frame 30 is defined by a top plate 60 and an opposite, substantially co-extensive and spaced parallel bottom plate 61. A stabilizer 36 comprising a formed C-channel is mounted on the top surface of the A-frame and mates to a stabilizer ½ ring 77 attached to the trip frame 70. The stabilizer 36 contains and stabilizes the ½ ring 77, thus stabilizing the trip frame to which the ½ ring 77 is attached. Those skilled in the art will appreciate that the stabilizer 36 can be designed having shapes other shapes than that shown, as long as it properly stabilizes the trip frame assembly 70.

Located in the body of the A-frame substantially between top and bottom surfaces 60, 61 is an actuator drive cavity. Locating the actuator drive means (preferably an electric/hydraulic pump assembly) substantially within the body of the A-frame 30 lightens the lift frame 10 (where the pump was conventionally located) for easy removal. Instead, the dead weight of the actuator drive means is advantageously added to the blade, assisting in creating a cleaner snowplow pass. Importantly, the actuator drive means in this location in no way obstructs the radiator of the vehicle, thereby allowing proper air flow to cool the vehicle engine and help prevent overheating. In addition, the actuator drive means is well sheltered, minimizing potential damage as the vehicle approaches the blade assembly for mounting. It also allows for shorter hydraulic lines to the angle pistons, and allows for more clearance in the basic geometry, thereby allowing higher blade motion for stacking snow. Preferably, the bulk of the actuator drive means is located substantially in the horizontal plane of the A-frame defined by the top and bottom surfaces 60, 61. Most preferably, a lower recess/skid plate coupled to the underside of plate 61 supports the pump assembly slightly below the plane of plate 61 of the A-frame 30, thereby maximizing the lift height of the A-frame 30. A removable top cover optionally having a hydraulic fluid reservoir fill cap 68 provides further protection for the pump assembly.

Trip frame assembly 70 is the preferred means for attaching the snow blade to the A-frame 30. The trip frame 70 allows the blade to pivot forward, which allows it to trip over obstacles and absorb shock that would otherwise be transferred into the plow frame assembly and vehicle, which in extreme cases would cause substantial damage. The front of the trip frame 70 is defined by a trip frame angle pivot, which comprises a top horizontal plate 96 and a spaced, parallel, co-extensive bottom horizontal plate 97. Angled plates 90, 91 receive the apex of the A-frame and provide a stop. The A-frame is pivotally mounted through axially aligned hole 92 in horizontal plates 96, 97. The trip frame angle pivot includes four horizontal axially aligned pivot bushings 70*a*–70*d* each mounted on a rib 83 intersecting horizontal top and bottom plates 96, 97. The pivot bushings 70*a*–70*d* each mate to a recess formed in the back of the plow blade. Welded at extreme opposite ends of trip frame 70 are right angle blade trip stops 73, 74. These provide an angled stop against the vertical blade rib of blade. Were the blade allowed to trip forward all the way to the ground, it could become lodged or could spring board up very abruptly, causing damage. In addition, the lower stop keeps the spring extension within its designed operating range which prevents the springs from stretching (overstretching of the springs permanently damages the springs, making them unable to return the blade to its full upright position).

Those skilled in the art will recognize that the foregoing trip frame assembly is not required; the snow blade can articulate directly from the A-frame and by directly coupled thereto via pistons and pivots. Other trip frame designs could also be used.

Welded on the top cross bar 96 is the ½ ring 77 mentioned above, which stabilizes the trip assembly and pivot. A right angle cross bar 85 is positioned within the ½ ring 77, and supports a plurality of trip return springs means 84*a*–84*n* (three shown). The opposite ends of the return springs means 84 are coupled to the snow blade through an upper spring mount on the rear of the blade.

A pair of spaced horizontal actuators such as cylinders 86, 87 are each mounted at one end between top and bottom horizontal plates 96, 97. The opposite ends of each horizontal actuator 86, 87 are pivotally coupled to the A-frame at shoulders 80, 80', 81, 81' (81' not shown). These horizontal actuators 86, 87 are operatively connected to the actuator drive assembly (not shown) housed in the A-frame 30 cavity by suitable hosing.

The snow blade can be conventional in design. The preferred blade is a sheet of steel bumped or rolled to a semi-round shape and then braced on the backside with a plurality of vertical ribs and horizontal members comprised of formed stiffeners and a frog angle at the very base to absorb shock. C-shaped shoe mounts coupled to the back of the plow blade provide a surface for the blade to ride on.

The controls for operating the assembly are housed inside the cab of the vehicle for easy access to the operator. Typically, there are two separate momentary contact switches in any position but the down position, where it is not momentary. A plurality of solenoids are used to control the mechanism, such as a solenoid to control the power that runs the motor for the pump. This circuit is energized off of any of the control positions except the down position, thereby actuating the pump to raise and/or angle the blade. Gravity allows the blade to return to ground. Three hydraulic solenoids are mounted to the output manifold of the pump. One is the unit that opens the path to lift the blade, another is the unit that opens the path to lower the blade assembly. In the up position, the first solenoid opens the valve and the pump is energized, which raises the blade. In the down position, the other solenoid opens its respective valve, but the pump is not energized, which allows the blade to lower.

There is a three-position hydraulic spool valve for the angling of the blade. As the switch is pushed to one side, it opens the corresponding valve and energizes the pump, which then pumps fluid into the corresponding piston which causes the piston to extend and to thereby angle the blade. At the same time, it allows the non-pressurized piston to collapse and fluid to return to the tank (the force of the extending piston collapses the opposite piston). When the switch is engaged in the other direction, the reverse occurs. When the switch is returned to the neutral position, so does the valve.

Receiver frame 11, preferably made of ⅜" mild steel, is coupled to the vehicle chassis by suitable means. The front plow engaging end of the receiver plate 11 includes a round elongated bar or rod 200, preferably solid and at least about 1" in diameter, secured to the receiver frame by suitable means such as welding. In the embodiment shown, the bar 200 extends horizontally a distance sufficient to be engaged at or near its opposite ends by a pair of opposite latch hooks 220 discussed in detail below. However, those skilled in the art will appreciate that the bar 200 need not be continuous; two separate bars could be used at each end of the receiver frame 11, as long as they are appropriately positioned for engagement by the latch hooks 220. Receiver frame 11 includes generally longitudinally extending (in the direction from the vehicle front to the vehicle rear) guide members 40, 41 as discussed above, which help ensure proper alignment of the lift assembly 10. The spacing or volume between these guide members and the top of receiver frame 11 is configured to accommodate the male ends 215*a*, 215*b* of the hitch assembly coupled to the lift frame 10 via the side gussets 54, 55. Thus the male ends 215*a*, 215*b* are preferably tapered as shown, and can include rounded corners to facilitate hitch engagement. Stated differently, the male ends 215*a*, 215*b* are each tapered such that the length of its free engaging end is shorter than the length of its opposite end coupled to the lift assembly. Similarly, guide members 40, 41 are configured and placed such that the receiver volume is tapered, with its end farthest from the vehicle front being shorter than the end at the bar 200. The guide members 40, 41 thus act as a track for receiving and aligning male ends 215*a*, 215*b*.

Pivotally coupled to each side gusset 54, 55 via pivot shaft 219 are respective latches 220. Preferably the latches 220 share a common pivot shaft, the pivot shaft extending from one latch to the other so that movement of the two latches is coordinated; actuation of one latch results in a corresponding movement of the other latch. In this way, the movement of the latches can be controlled by a single lever 221 coupled to one of the latches 220. Alternatively, separate pivot pins could be used for each latch 220, with each latch having separate means for actuation.

Each latch 200 has a hook shape including an arcuate recess 225 corresponding in angle to the circumference of the bar 200. The latch is thereby adapted to receive the bar 200. Preferably the tip 228 of the hook extends beyond the body of the latch. This design facilitates the grasping and interlocking of bar 200 of receiver frame 11. Preferably the latches 220 are positioned such that the arcuate recess 225 is open to (i.e., faces) the bar 200 of receiver plate 11 when in the unattached position. Each latch 220 includes a lower sloped portion 227 that serves to guide bar 200 into the arcuate recess 225, and an opposite hook 228 that helps engage the bar 200 once guided into arcuate recess 225.

This positioning of latches 220 relative to bar 200 allows for the automatic or semi-automatic mounting of the lift frame 10 to the vehicle. Once the height of the lift frame 10 relative to the bar 200 is appropriately positioned (which is preferably accomplished by proper movement of the jack as discussed above), the vehicle to which the receiver plate 11 is attached is simply driven towards the lift frame 10 until the latches 220 engage the bar 200. Due to the configuration of the slope portion 227, hook portion 228 and arcuate recess 225, the force of the bar 200 engaging the latches 220 cause the latches 220 to rotate counterclockwise and lock the bar 200 in place. Suitable locking pins (not shown) or other safety locking mechanism can be used to ensure that the lift frame 10 does not prematurely disengage from the vehicle. One suitable locking assembly includes a spring loaded pin assembly, with spring biasing against the pin. In the locked position, the spring forces the pin through an appropriately dimensioned aperture in side gusset 54, thereby fixing the latch 220 in place. A lever prevents the pin from retracting out of the aperture in the gusset 54. In the unlocked position, the pin is retracted from the aperture, allowing movement of the latch for engagement or disengagement of the hitch. Each latch 200 can have a safety lock, or preferably a single safety lock can be used, preferably in conjunction with the latch that is located on the same side of the apparatus as lever 221, for operator convenience.

Those skilled in the art will appreciate that the latches 220 (i.e., the engaging means) could be located on the receiver plate 11, and the bar 200 (i.e., the engaged means) on the lift assembly 10. Thus, the receiver 11 and the lift assembly 10 cooperate to create a releasable coupling of the two.

Figure 2:
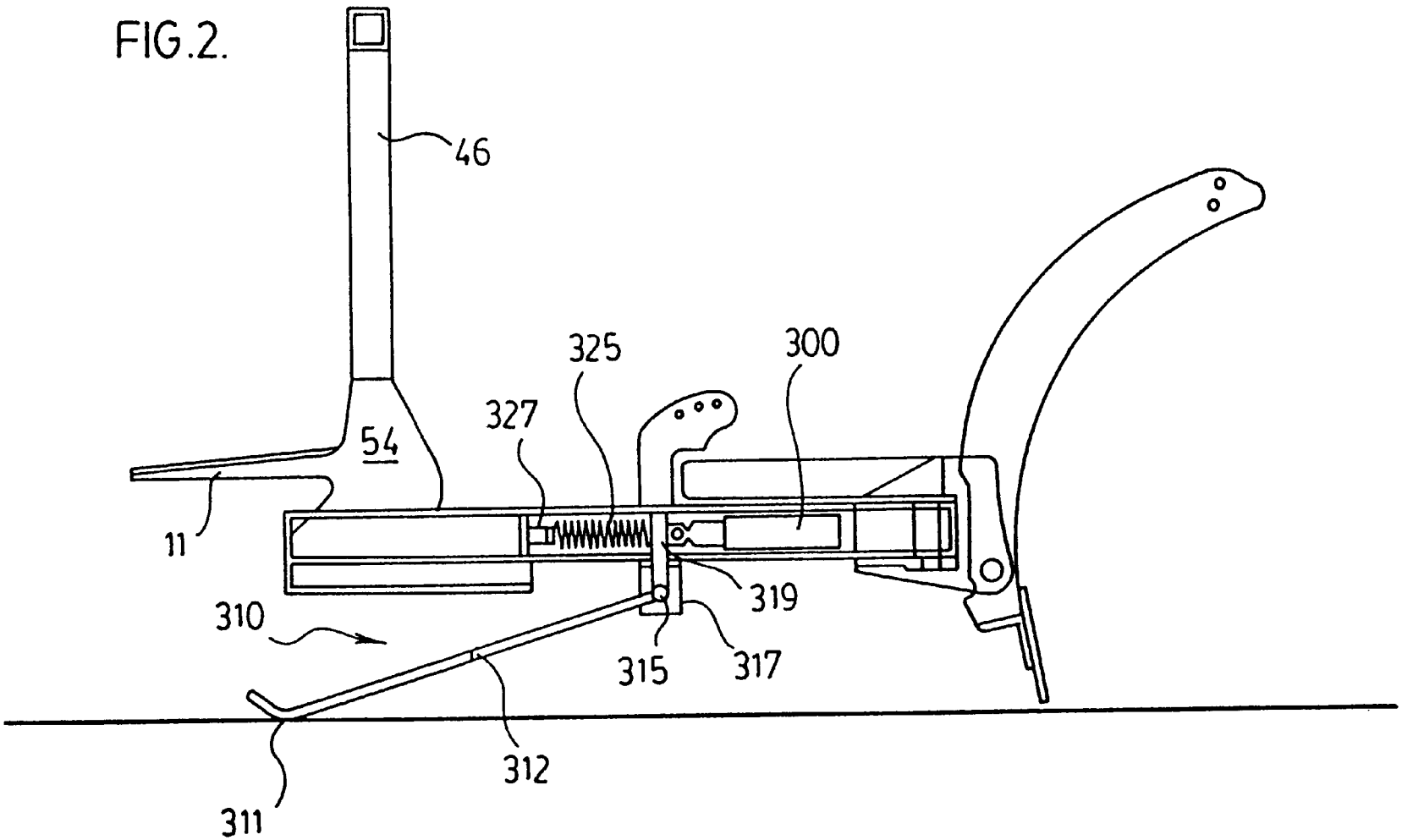
FIG. 2 is a cross-sectional view of one embodiment of the jack assembly in accordance with the present invention.

Turning now to FIG. 2, one embodiment of the jack assembly of the present invention is shown. The jack is preferably power operated with drive means such as by a hydraulic cylinder 300 positioned in the cavity of the A-frame as shown, or with a screw jack (e.g., electric or manual) similarly positioned. The cylinder 300 is located in the body of the A-frame substantially between top and bottom surfaces 60, 61 in the actuator drive cavity, forward (away from the vehicle) of where the snow blade hydraulic assembly is located. Locating this jack drive means substantially within the body of the A-frame 30 lightens the lift frame 20 (where the pump was conventionally located) for easy removal. Instead, the dead weight of the jack drive means is advantageously added to the blade, assisting in creating a cleaner snowplow pass. Importantly, the jack drive means in this location in no way obstructs the radiator of the vehicle, thereby allowing proper air flow to cool the vehicle engine and help prevent overheating. In addition, the jack drive means is well sheltered, minimizing potential damage as the vehicle approaches the blade assembly for mounting. Preferably, the bulk of the jack drive means is located substantially in the horizontal plane of the A-frame defined by the top and bottom surfaces 60, 61. Jack foot 310 is rigid so as to support the weight of the item being lifted and lowered, and is preferably made of steel. The jack foot 310, which preferably includes a curved skid shoe portion 311 for contacting the ground (or other substrate) and a relatively straight elongated portion 312, is coupled to tab 319, such as by welding, at about a 45° angle. This assembly is pivotally coupled to the A-frame assembly via pin 315 through opposite side gussets 317 (one shown) The jack shoe 311 is lowered by actuation of the hydraulic cylinder 300, which contacts the tab 319 and causes counterclockwise rotational movement of the tab 319 about the axis of the pin 315. A return spring 325 biases against the cylinder 300 such that the jack 310 can be raised by retraction of the cylinder 300, this time by clockwise rotational movement of the tab 319 about the axis of the pin 315. An adjusting nut 327 is used to provide the proper tension on spring 325. Alternatively, the spring 325 can be eliminated by using a multi-stage hydraulic cylinder, which is coupled to the jack by any suitable means to raise and lower the same. By lowering the jack 310, the jack shoe 11 engages the ground (or other substrate), supports the lift assembly, and raises the lift assembly to the appropriate height for engagement with the hitch assembly mounted on the vehicle. This design allows for raising or lowering of the jack to virtually any extent within its raised (i.e., stowed in a position where the jack will not interfere with the operation of the snow plow or other utilitarian accessory, such as a position parallel or substantially parallel to the A-frame) and lowered (i.e., as shown in FIG. 2) range, in contrast to the prior art which allowed for only incremental lowering or raising (such as in half inch or one inch increments). This non-incremental, infinite height adjustment greatly facilitates the mounting operation, especially where the height of the vehicle relative to the lift assembly has changed, such as due to snow accumulation on the ground. Preferably the hydraulic controls are placed in an accessible location, such as the front of the vehicle grill, so that the operator can operate the jack while visually inspecting the height of the lift assembly and align it appropriately with the vehicle. Preferably the hydraulic controls include a flow divider which routes the hydraulic fluid to either the actuator drive or to the jack drive, as needed. The actuation means for raising and lowering the jack is dedicated to this operation, thereby eliminating any labor that would be necessary were one to use an actuator that is "borrowed" from another application, such as the cylinder 52 for lowering or raising the plow blade.

Figure 3:
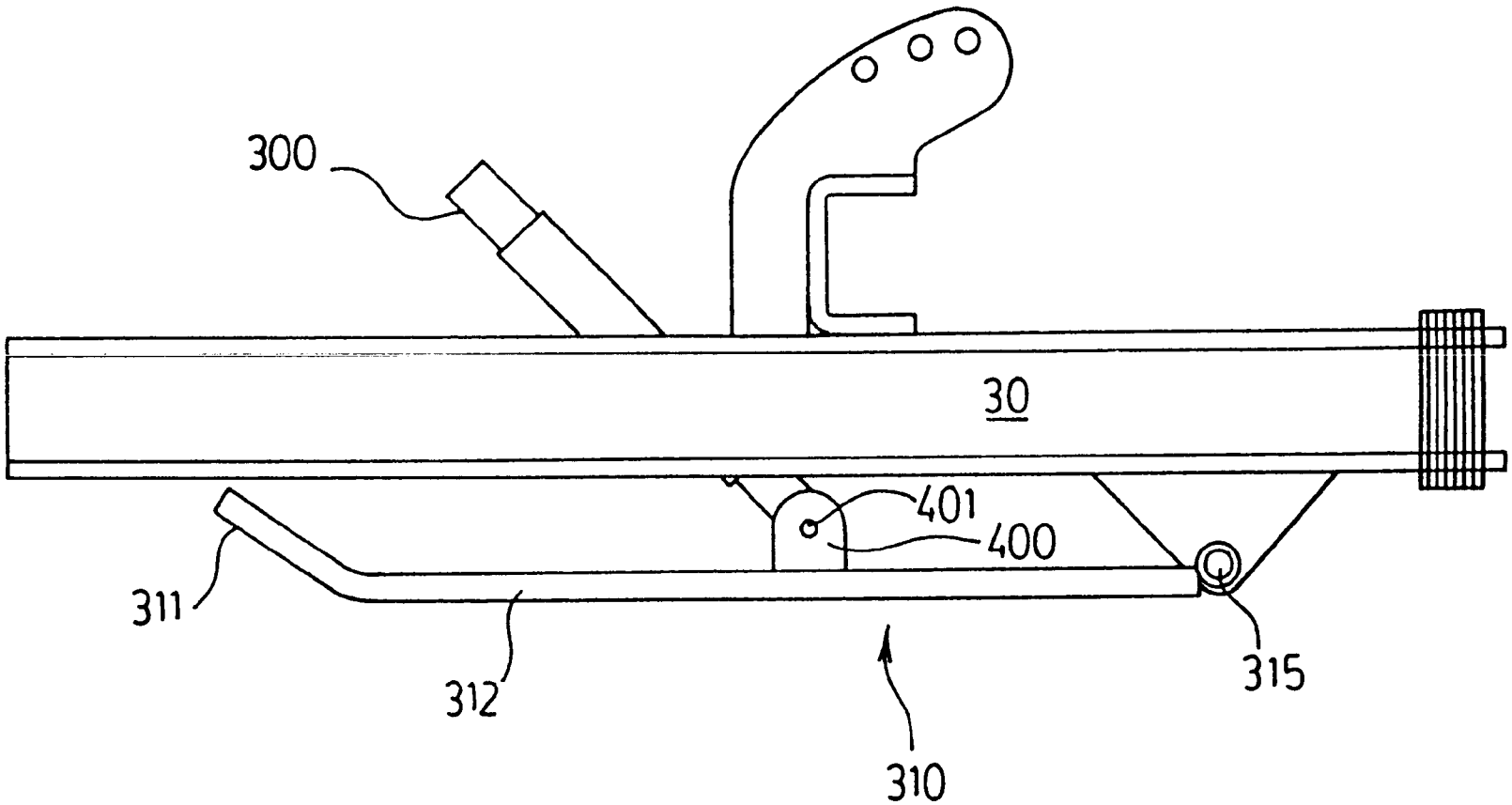
FIG. 3 is a side view of a second embodiment of the jack assembly in accordance with the present invention.

FIG. 3 shows an alternative embodiment of the jack assembly. Jack drive means 300, such as a screw jack or more preferably a multistage hydraulic cylinder, is fixed to the jack between jack shoe 311 and pivot pin 315, preferably about midway therebetween, at 400 such as with a pin 401, preferably at about a 45° angle thereto. The jack 310 is pivotally connected to the A-frame 30 at pin 315, allowing the jack 310 to move between a retracted position parallel or substantially parallel to the A-frame as shown in the Figure, to a ground-engaging position (not shown), wherein the relatively straight elongated portion 312 of the jack 310 can be approximately perpendicular to the ground but is preferably about 45° to the ground.

Figure 4:
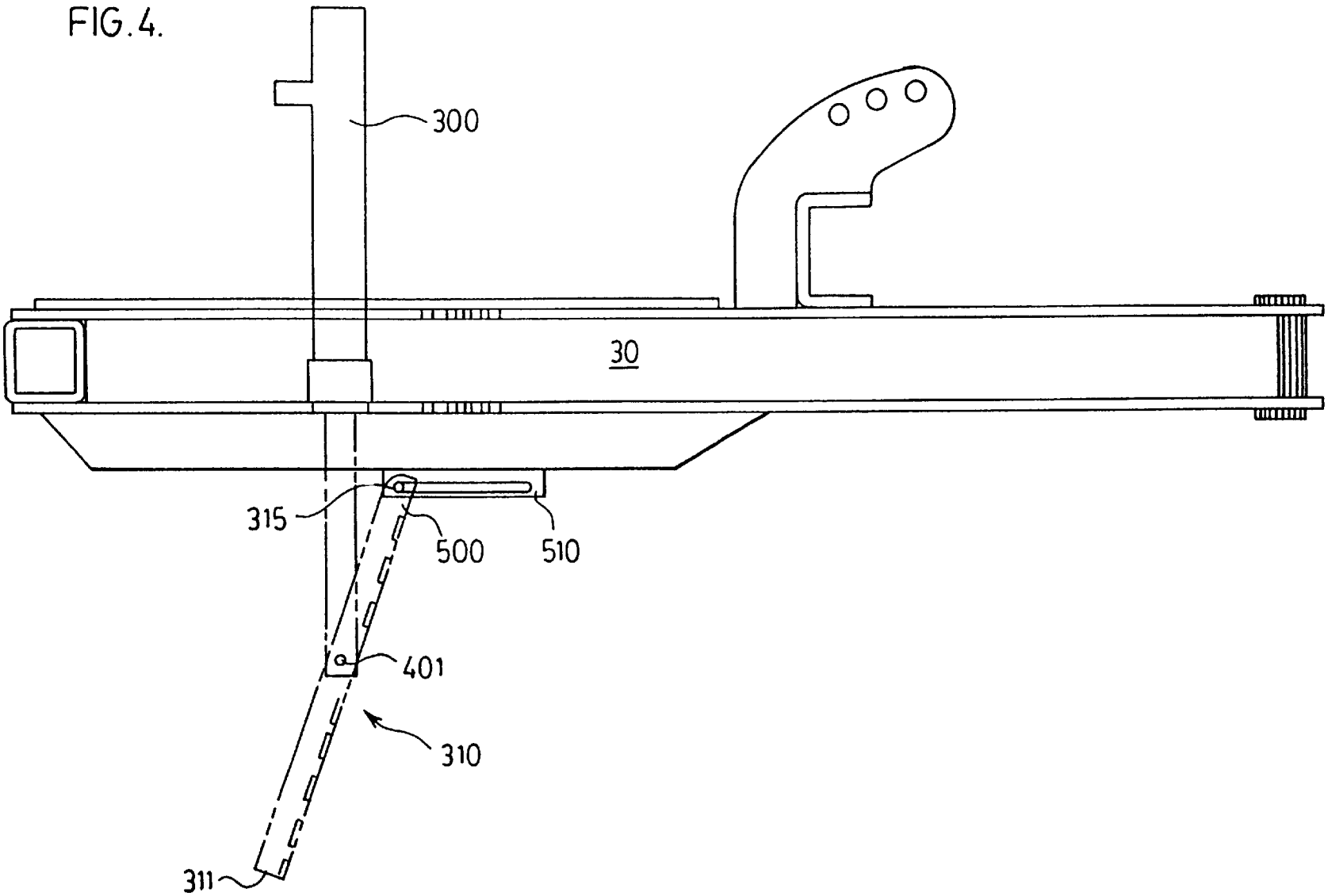
FIG. 4 is a side view of a third embodiment of the jack assembly in accordance with the present invention.

FIG. 4 shows another alternative embodiment of the jack assembly. Jack drive means 300, such as a screw jack (e.g., electric or manual screw) or more preferably a single stage hydraulic cylinder, is fixed to the jack such as with a pin 401, preferably at about a 45° angle thereto. The jack 300 has an A-frame engaging end 500 and a spaced foot 311 for engaging the ground (or other substrate). Preferably the jack drive means 300 is fixed to the jack about midway between end 500 and foot 311. The jack 310 is movably connected to the A-frame 30 at pin 315, allowing the jack 310 to slide in the track or retaining guide created by slotted bracket 510 and move between a retracted position parallel or substantially parallel to the A-frame, and a ground-engaging position as shown in FIG. 4, wherein the relatively straight elongated portion 312 of the jack 310 can be approximately perpendicular to the ground but is preferably about 45° to the ground.

Figure 5A:
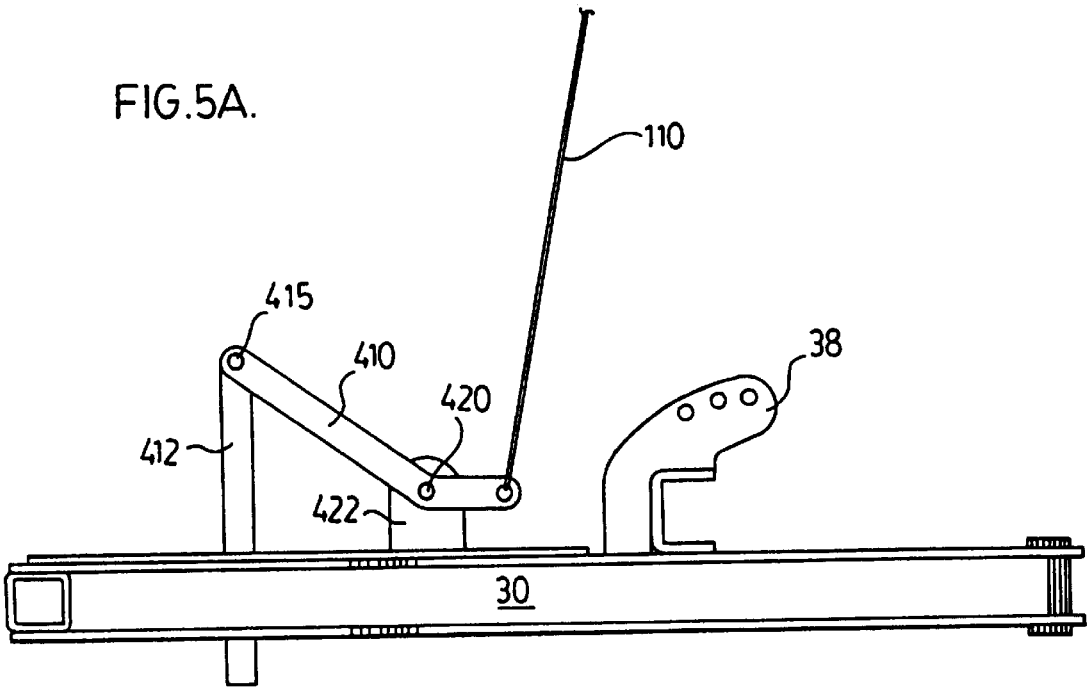
FIG. 5A is a side view of a fourth embodiment of the jack assembly in accordance with the present invention, shown in a raised position.
Figure 5B:
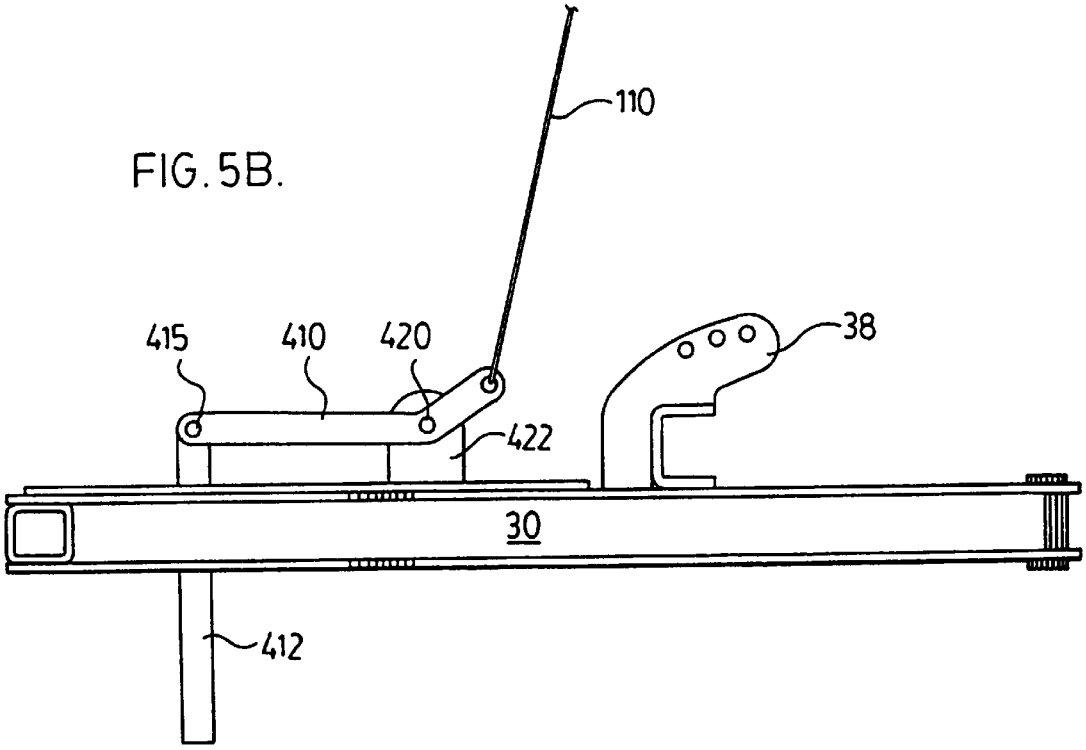
FIG. 5B is a side view of a fourth embodiment of the jack assembly in accordance with the present invention, shown in a lowered or deployed position.

FIGS. 5A and 5B show another alternative embodiment of the jack assembly. In this embodiment, a chain 110 or the like, which is generally coupled to attachment 38 for raising and lowering the plow, is disconnected from attachment 38 and coupled to the jack. The jack includes an L-shaped leg 410 pivotally connected at one end to an elongated leg 412, such as with pin 415. The L-shaped leg 410 also pivots through the axis of pin 420 on mounting plates 422. Actuating the lift assembly lift cylinder 52 (FIG. 1) causes chain 110 to life the jack into the deployed position shown in FIG. 5B.

Figure 6:
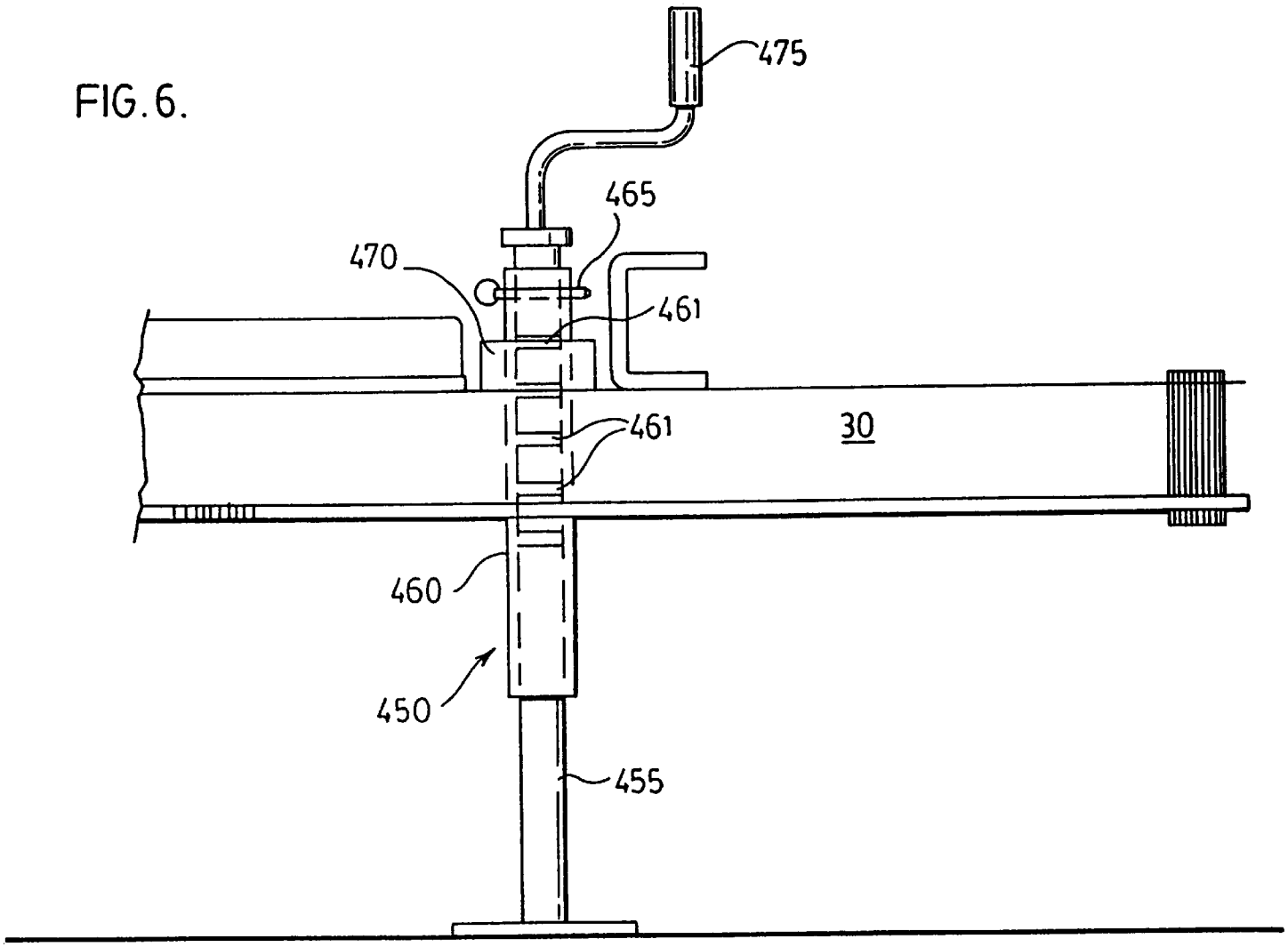
FIG. 6 is a side view of a fifth embodiment of the jack assembly in accordance with the present invention.

FIG. 6 shows another alternative embodiment of the jack assembly. In this embodiment, screw style jack 450 includes an inner shaft 455 received in an outer housing 460 that is threaded in at least a portion of its outer surface. The inner shaft 455 includes a plurality of key holes or slots 461, into which pin 465 is slidingly engageable to lock the inner shaft 455 in place relative to the outer housing 460. To that end, the outer housing also has a slot near its upper end for insertion of pin 465. Removal of the pin 465 allows the inner shaft to drop to the ground by action of gravity. The pin 465 is then re-inserted through the appropriate slot 461, locking the inner shaft 455 in place. Further adjustment is then obtained by rotating the threaded outer housing/inner shaft combination about its longitudinal axis through fixed nut 470 coupled to the A-frame 30. Handle 475 is provided for ease in rotating the assembly.

Figure 7:
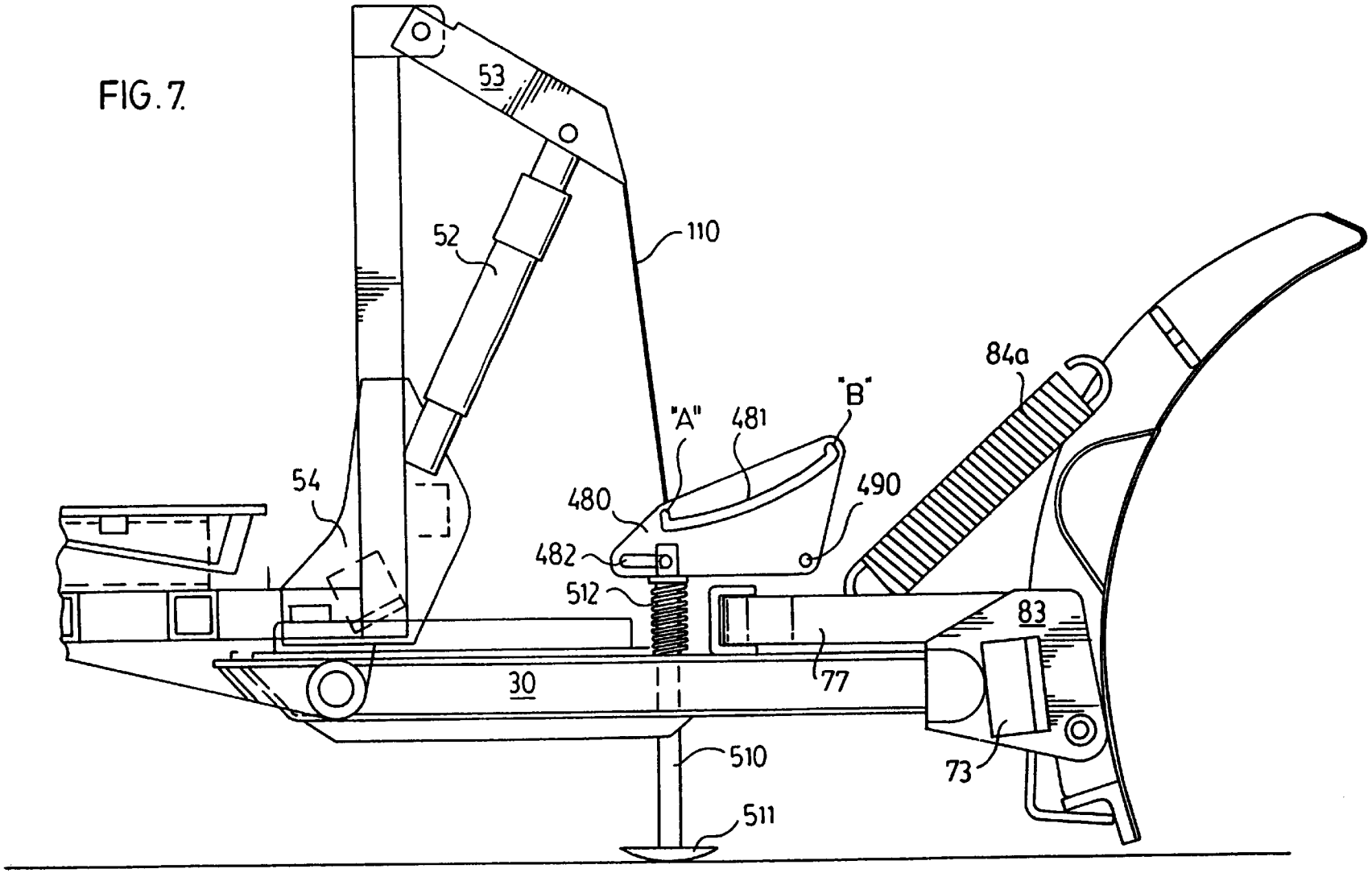
FIG. 7 is a side view of a sixth embodiment of the jack assembly in accordance with the present invention.

FIG. 7 shows a further embodiment of the jack assembly. In this embodiment, a rocker 480 is used, having a slot 481. Linking means 110 such as a chain has a first end fixed to the hood 53, and a spaced second end coupled to the rocker 480 in slot 481. Also coupled to the rocker 480 in slot 482 is the jack 510, which is an elongated leg terminating in a shoe 511. A spring 512 surrounds the elongated leg between the rocker 480 and the A-frame 30 as shown. The linking means 110 is shown in position "A", in which the jack 510 is in the deployed position, the shoe 511 contacting the ground. As the linking means 110 is raised, the rocker 480 pivots about pin 490 until the linking means 110 is now in position "B" in slot 481. This causes a corresponding lifting of the jack 510 in the vertical direction towards the A-frame 30. As the lifting continues, the shoe 511 contacts the A-frame, providing a stop to the vertical movement of the jack 510. Continued lifting the linking means 110 results in lifting of the plow blade.

In a preferred embodiment, the jack activation switch includes two built-in safety features. When the jack is to be used, it is controlled by a switch on the A-frame (or the vehicle grill). However, the switch will not activate the jack unless the in-cab controls are locked in the float (i.e., lower) position, as only in this position is power supplied to the jack switch. As a result, it is not possible to operate the jack while the snow plow is in the raised position, as this could be potentially hazardous to the user. In addition, once the plow is locked securely on the vehicle, if the jack is not retracted, there is a wired-in safety to ensure that the jack arm is retracted prior to activating the plow blade. Specifically, the in-cab plow blade lift control is wired to the jack retract circuit. As a result, if the jack is not retracted, when the operator used the in-cab lift function, the jack will automatically retract, making it impossible to operate the snow plow blade with the jack in the extended position.

In operation, the vehicle is positioned close to the hitch assembly, and the jack mechanism is operated so that the lift assembly is raised or lowered depending upon the height of the receiver plate 11. Once the proper height is achieved (as determined by visual inspection), the vehicle is driven towards the male end 215 of the hitch assembly so that it is received under the receiver plate 11. At this point the latches 220 are in the unlocked position shown in FIG. 1, configured to grasp and engage the bar 200. Once the bar 200 is positioned in the recesses 225 of the latches 220, the lever 221 is used to draw the latches 220 around the bar 200 and interlock the same. The lift assembly is now locked to the vehicle chassis. The jack is then retracted to its inoperative position where it is stowed during use of the plow. To disengage the lift assembly from the chassis, the jack is lowered to the ground to support the assembly, and the lever 221 is placed in the up position, which pushes the latch away from the bar 200, disengaging the same and actually pushing the receiver plate 11 away from the lift assembly.

Those skilled in the art will appreciate that the present invention is not limited to application to snow plows; other utilitarian accessories such as brushes, sweepers, carts, push bars, hitches, winches, etc. can be used.

What is claimed is:

1. Jack for raising or lowering a lift assembly having a utilitarian accessory attached thereto relative to a substrate, comprising:

a lift assembly adapted to be mounted to a vehicle chassis;

a jack having a first portion coupled to said lift assembly, and a second portion spaced from said first portion adapted to contact said substrate;

a first actuator for moving said utilitarian accessory between a substrate-engaging position and a position wherein said utilitarian accessory is not engaging said substrate; and a second actuator for causing said second portion of said jack to contact said substrate only when said utilitarian accessory is in said substrate-engaging position, and for forcing said second portion against said substrate so as to raise said lift assembly relative to said substrate.

2. The jack of claim 1, wherein said second actuator is dedicated to said second portion of said jack to contact said substrate and forcing said s substrate.

3. The jack of claim 1, wherein said first and second actuators each comprising cylinder.

4. The jack of claim 3, wherein at least one of said first and second actuators is a multistage hydraulic cylinder.

5. The jack of claim 1, wherein said substrate is the ground.

6. The jack of claim 1, wherein said second actuator moves said jack to a substantially horizontal position relative to said substrate when said utilitarian accessory is not engaging said substrate.

7. Jack for raising or lowering a lift assembly having a utilitarian accessory attached thereto relative to a substrates comprising:

a lift assembly adapted to be mounted to a vehicle chassis;

a jack having a first portion coupled to said lift assembly, and a second portion spaced from said first portion adapted to contact said substrate;

a first actuator for moving said utilitarian accessory between a substrate-engaging position and a position wherein said utilitarian accessory is not engaging said substrate; and a second actuator for moving said jack to and from a substrate-engaging position;

whereby said second portion of said jack contacts said substrate only when said utilitarian accessory is in its substrate-engaging position.

* * * * *